US005518133A

United States Patent [19]

Hayes et al.

[11] Patent Number: 5,518,133

[45] Date of Patent: May 21, 1996

[54] PACKAGING TAB

[75] Inventors: Thomas J. Hayes, Wauconda; Stephen A. Smith, Naperville, both of Ill.

[73] Assignee: Packaging Corp. of America, Evanston, Ill.

[21] Appl. No.: 385,711

[22] Filed: Feb. 7, 1995

[51] Int. Cl.[6] ..... B65D 17/34

[52] U.S. Cl. ..... 220/306; 220/356; 220/270

[58] Field of Search ..... 220/555, 306, 220/352, 355, 356, 270

[56] References Cited

U.S. PATENT DOCUMENTS

| | | | |
|---|---|---|---|
| 4,280,635 | 7/1981 | Murphy | 220/306 |
| 4,362,252 | 12/1982 | Graff | 220/306 X |
| 4,376,493 | 3/1983 | Gall | 220/306 X |
| 4,390,113 | 6/1983 | Bird | 220/306 |
| 4,856,674 | 8/1989 | Berney | 220/306 X |
| 5,377,860 | 1/1995 | Littlejohn et al. | 220/306 |
| 5,441,166 | 8/1995 | Lucas, Jr. et al. | 220/306 |

OTHER PUBLICATIONS

Packaging lid, Source believed to be Detroit Forming, Inc. of Southfield, MI.

Drawings of packaging lid (BA), Figs. A–B.

Declaration of Thomas J. Hayes, pp. 1–4 with Attachment A.

*Primary Examiner*—Steven M. Pollard

*Attorney, Agent, or Firm*—Arnold, White & Durkee

[57] ABSTRACT

A cover for a packaging arrangement, comprising a side flange having an undercut disposed therein for releasably engaging a base of said packaging arrangement; and a non-planar shaped tab having a first edge connected to said side flange along the length of said first edge and having a second edge connected to said side flange only at the terminating points of said second edge, said undercut extending in a continuous, unbroken manner in the vicinity of said tab.

37 Claims, 7 Drawing Sheets

PRIOR ART

PACKAGING TAB

BACKGROUND OF THE INVENTION

1. Field of the Invention

The present invention relates to packaging arrangements, and particularly to a tab for the covers of such packaging arrangements.

2. Description of the Related Art

Many containers today comprise a base portion having a rim or protruding portion around the top periphery of the base, known as a "top-out", and a cover having an undercut or series there of extending around the periphery of the cover designed to snap over the top-out of the base. This design permits the cover to fit securely to the base. In order to open the package, the cover and the base must be pried apart.

In some containers, the top-out of the base and the undercut of the cover extend in a continuous manner about the periphery of each such that when the undercut snaps over the top-out, a continuous interface between the cover and the base about the periphery of the package is formed. This continuous interface contributes to the leak resistance of the package.

To aid in separating the cover and the base, a tab is often attached to the cover. Two basic types of tabs are flat tabs and indentation tabs. Flat tabs, as their name implies, are flat projections which may extend from the cover, base, or both. While flat tabs may be incorporated into a packaging arrangement without interfering with the continuous interface between the cover and the base, they generally do not possess much structural integrity or rigidity and hence often bend in the process of opening a package. This bending can make it more difficult to open the package.

A second type of tab is an indentation tab. An indentation tab provides a cavity under the cover through which a finger or other object may be inserted into a gap between the cover and the base. The package may then be opened by applying leverage between the cover and the base. While having greater structural integrity, indentation tabs suffer from the disadvantage of yielding a less leak resistant package because they introduce a gap in the interface between the cover and the base and interrupt the continuity of the undercut around the periphery of the cover. Furthermore, if an upward force is applied to the bottom of an indentation tab in an effort to open the package, the undercut surrounding the tab is not drawn away from the top-out and may even be drawn into greater frictional contact with the top-out. As a result, it can be difficult to open a package having an indentation tab through the application of an upward force to the indentation tab.

SUMMARY OF THE INVENTION

Accordingly, an object of the present invention is to provide an easy open tab design to assist in separating the cover and the base of a packaging arrangement.

Another object of the present invention is to provide a tab having a relatively high degree of structural integrity.

An additional object of the present invention is to provide a tab design which need not interrupt the continuity of the interface between the cover and the base of the packaging arrangement.

The tab of the present invention is designed to overcome the shortcomings of the presently known tab designs. A preferred embodiment of the invented tab has a non-planar shape and is connected to a side flange of a cover without interfering with the continuity of an undercut disposed in the side flange. The design of the invented tab thus provides a degree of structural integrity in the area of the invented tab while not interfering with the ability to provide a leak resistant packaging arrangement. Furthermore, the design of the invented tab aids in separating the undercut of the cover from the top-out of the base in the area of the tab, thus yielding a package which is easier to open.

BRIEF DESCRIPTION OF THE DRAWINGS

Other objects and advantages of the invention will become apparent upon reading the following detailed description in conjunction with the drawings in which:

FIGS. 4*a*–7*a* are perspective views and FIGS. 4*b*–7*b* are side views of a packaging arrangement having a base and a domed cover incorporating alternative preferred embodiments of tabs in accordance with the present invention;

DESCRIPTION OF THE PREFERRED EMBODIMENTS

Figure 1A:
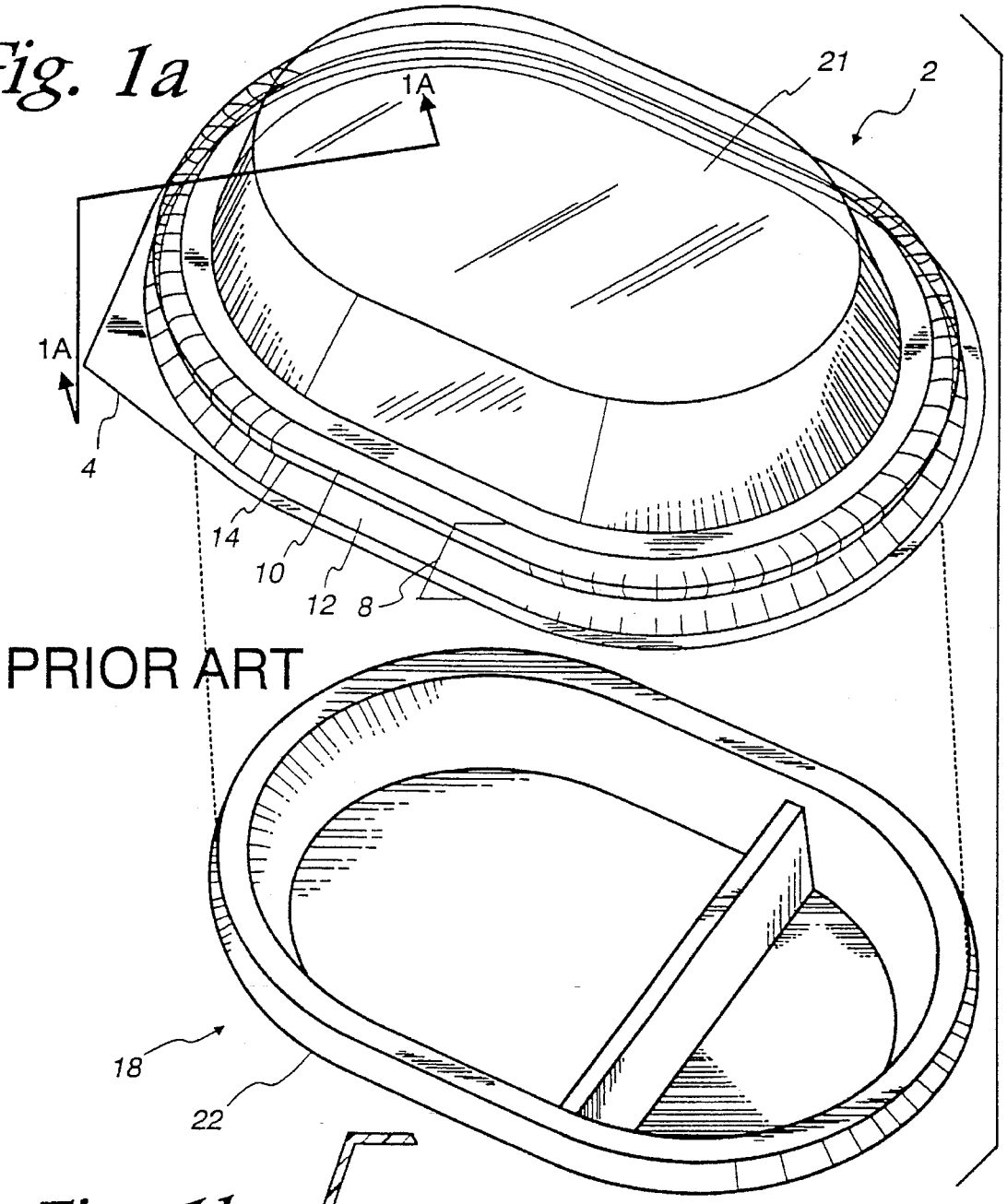
FIG. 1*a* is a perspective view and FIG. 1*b* is a side view of a packaging arrangement having a base and a domed cover incorporating a prior art flat tab design.

The preferred embodiments of the present invention will now be described in conjunction with the drawings in which corresponding features are designated with the same reference numerals.

Figure 1B:
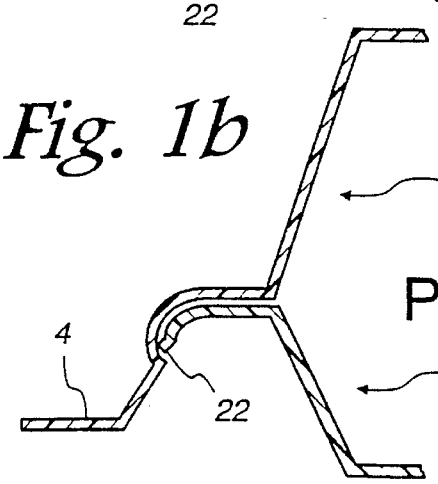
PRIOR ART Fig. 1b

FIG. 1*a* is a perspective view and FIG. 1*b* is a side view of a packaging arrangement having a base 18 and a domed cover 2 incorporating a prior art flat tab design 4. The base 18 has a top-out 22 around the top periphery of the base 18. The cover 2 has a top surface 21 and a side flange 8 extending downwardly from the periphery of the top surface 21, the side flange 8 thereby defining a side periphery. The side flange 8 comprises an upper flange 10, a lower flange 12, and an undercut 14 disposed therebetween. The undercut 14 is designed to releasably engage the base 18 by snapping over the top-out 22. As depicted in FIG. 1*a*, the undercut circumscribes the side periphery in a continuous and unbroken manner. Due to the lack of sufficient structural integrity, the flat tab 4 of FIGS. 1 and 1A bends when force is applied. This bending can make opening a packaging arrangement having a flat tab design more difficult.

Figure 2A:
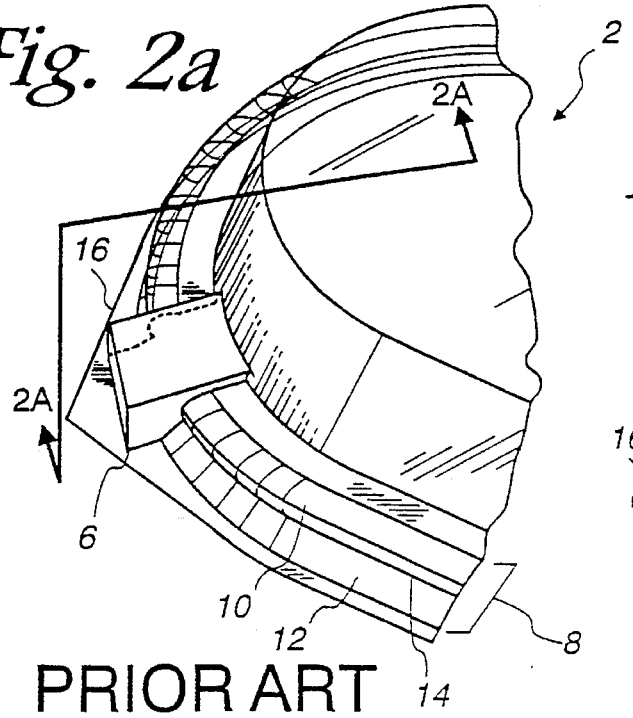
FIG. 2*a* is a perspective view and FIG. 2*b* is a side view of a packaging arrangement having a base and a domed cover incorporating a prior art indentation tab design.
Figure 2B:
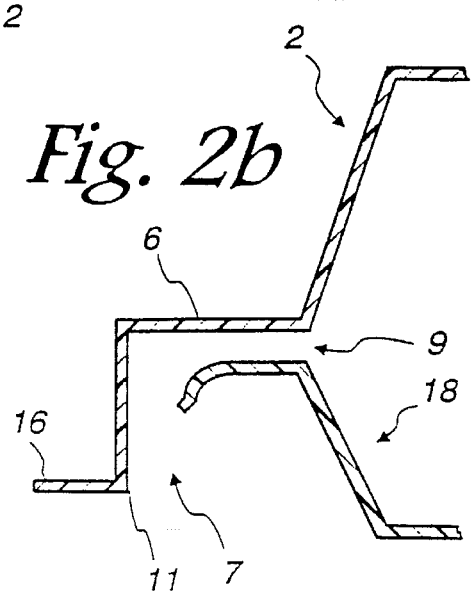
PRIOR ART Fig. 2b

FIG. 2*a* is a perspective view and FIG. 2*b* is a side view of a packaging arrangement having a base 18 and a domed cover 2 incorporating a prior art indentation tab design 6. The domed cover 2 has a side flange 8 comprising an upper flange 10, a lower flange 12, and an undercut 14 disposed therebetween. The undercut 14 is designed to releasably engage a top-out 22 of a base 18 (see FIG. 1*a*). A bottom flange 16 extends from the lower flange 12. The indentation tab 6 provides a cavity 7 underneath the tab 6 through which a finger or other object may pass in gaining access to a gap 9 created between the cover 2 and the base 18. A finger placed in the gap may then be used to open the packaging arrangement by applying leverage between the cover 2 and the base 18 wherein the finger pivots about the bottom edge 11 of the tab 6 while the tip of the finger exerts downward pressure on the base 18. However, in providing the cavity 7 and the gap 9, the indentation tab 6 interrupts the continuity of the undercut 14 and the upper flange 10 in the region under the indentation tab 6. This discontinuity in the undercut 14 and the upper flange 10 disrupts the continuity of the interface between the cover 2 and the base when the undercut 14 engages the base. Because liquids may spill out of the package through the gap 9 and the cavity 7 created in the interface between the cover 2 and the base 18, the package becomes less leak resistant.

Figure 3A:
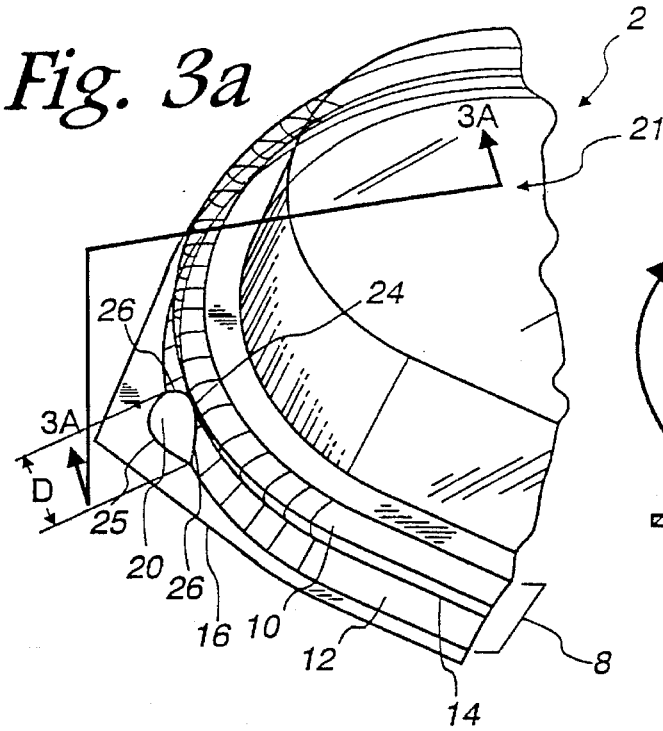
PRIOR ART Fig. 3a
FIG. 3*a* is a perspective view and FIG. 3*b* is a side view of a packaging arrangement having a base and a domed cover incorporating a preferred embodiment of a tab in accordance with the present invention.
Figure 3B:
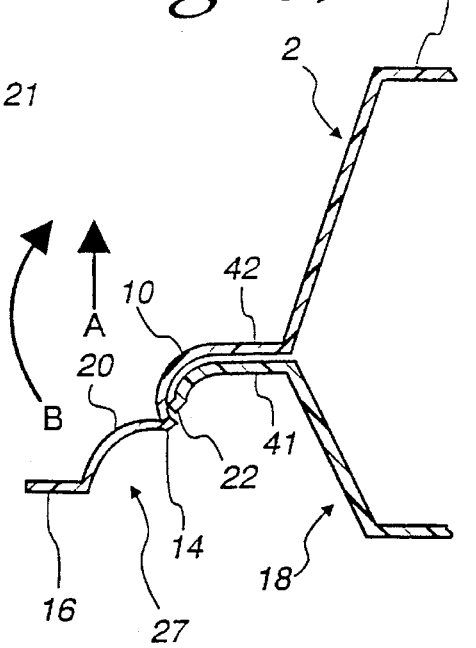

FIG. 3*a* is a perspective view and FIG. 3*b* is a side view of a packaging arrangement having a base 18 and a domed cover 2 incorporating a preferred embodiment of a tab 20. The base 18 has a top-out 22 around the top periphery of the base. The cover 2 has a top surface 21 and a side flange 8 extending downwardly from the periphery of the top surface 21, the side flange 8 thereby defining a side periphery. The side flange 8 comprises an upper flange 10, a lower flange 12, and an undercut 14 disposed therebetween. The undercut 14 is designed to releasably engage the base 18 by snapping over the top-out 22. As depicted in FIG. 3*a*, the undercut circumscribes the side periphery in a continuous and unbroken manner. A bottom flange 16 extends from the lower flange 12. Tab 20 of FIG. 3*a* has a bottom edge 25 extending from the bottom flange 16, a top edge 24 extending from the side flange 8 along or close to the undercut 14, and side edges 26 extending from the lower flange 12. The non-planar shape of tab 20 forms a cavity 27 under tab 20 having an opening defined by the bottom edge 25, the side edges 26, and the top edge 24 of the tab 20.

It should be noted that the invented tab does not interrupt the continuity of the undercut 14 or the upper flange 10. Accordingly, the invented tab does not interfere with the ability to provide a leak resistant packaging arrangement having a continuous base-cover interface about the periphery of the packaging arrangement when the undercut 14 releasably engages or snaps over the top-out 22. Such a base-cover interface is illustrated in FIG. 3*b* by the contact between the top-out 22 of the base 18 and the inner surface of the upper flange 10. Likewise a base-cover interface may exist between a top ledge 41 of the base 18 and a top ledge 42 of the top surface 21 of the cover 2.

Additionally, the non-planar geometry of the invented tab enhances the structural integrity of the tab 20. As a result of this enhanced structural integrity, the tab 20 does not unduly bend upon the application of force during the opening process which contributes to a packaging arrangement which is easier to open. Furthermore, the non-planar geometry of the invented tab and the manner by which it is integrated with the side flange 8 and bottom flange 16 enhance the removeability of the cover 2 from the base 18. For example, the non-planar geometry of the invented tab and the manner by which it is integrated with the side flange 8 and bottom flange 16 serve to draw the undercut 14 away from the top out 22 of the base 18 when the tab is bent during opening as is discussed below.

To open a packaging arrangement incorporating the tab 20, the tab 20 and bottom flange 16 may be grasped between a finger and a thumb and then pulled either upwardly (arrow A of FIG. 3*b*) or upwardly and away from the top-out 22 of the base 18 and then about the top-out 22 (arrow B of FIG. 3*b*). When the tab 20 is pulled upwardly (arrow A) the undercut 14 slides up and over the top-out 22 disengaging the cover 2 from the base 18. The configuration of tab 20 of FIGS. 3*a* and 3*b* may serve to draw the undercut 14 away from the top-out 22 when force is applied thereto assisting in disengaging the undercut 14 from the top-out 22.

When the tab 20 is pulled upwardly and away from the top-out 22 (arrow B), the undercut 14 moves away from the top-out 22, reducing the frictional resistance between the top-out 22 and the undercut 14 as the undercut 14 slides up and over the top-out 22. The continuous nature of the undercut 14 in the area of the tab 20 contributes to an easier opening package. This is in contradistinction to the indentation tab 6 of FIG. 2*a* in which the undercut 14 is discontinued under the tab 6. If one attempted to open the packaging arrangement of FIGS. 2*a* and 2*b* in a manner similar to that described above in connection with FIG. 3*b*, namely by pulling upwardly on the tab 6 of FIGS. 2*a* and 2*b*, the undercut 14 surrounding the tab 6 is drawn into tighter contact with the top-out, thus increasing the frictional resistance between the undercut and the top-out. Thus, even in packaging arrangements where leak resistance is not a concern, the indentation tab 6 (FIGS. 2*a* and 2*b*) is disadvantageous when compared with the tab 20 (FIGS. 3*a* and 3*b*) in that it is more difficult to open by pulling on the tab.

It should be noted that where leak resistance is not a major concern, the tab may be incorporated into a cover having an intermittent undercut provided the undercut is continuous in the vicinity of the tab or at least the cover to base top-out interface is not interrupted in the vicinity of the tab. For example, where the tab is connected to a rounded comer of a cover (such as in FIG. 3*a*), it is desirable that the undercut be continuous in the region depicted by the letter D.

The cover 2 is typically made of plastic while the base 18 is typically made of either plastic or foil. However, the type of material from which the packaging arrangement is constructed is not critical to the invention; but rather, the choice of materials may be influenced to a greater degree by the intended use of the packaging arrangement and possible materials include not only plastic and foil but also paper products, molded fiber, and other suitable materials. Plastic bases and covers may be manufactured by thermo forming, also known as pressure and/or vacuum forming. The thickness of plastic material may vary generally between 0.007 and 0.028 of an inch depending upon the intended use of the packaging arrangement but is more typically between 0.015 and 0.02 of an inch. Heavier gages of plastic may reduce the ease of opening of a packaging arrangement incorporating a tab according to the present invention. A good combination of structural integrity and flexibility has been obtained with packaging arrangements incorporating a tab according to the present invention made from plastic having thicknesses ranging from 0.01 to 0.016 of an inch.

The tab may be formed integrally with the cover or formed separately from the cover and subsequently connected thereto.

Additionally, while the depicted packaging arrangement of FIG. 3*a* has a general oval shape and a domed cover, the invented tab may be used on a variety of containers. For example, the overall package may have a rectangular, multisided, or rounded shape or the cover may be a flat lid or a recessed lid. The present invention is not limited by the shape of the packaging arrangement.

The invented tab has been depicted, by way of example, as having a generally spherical or rounded shape resembling somewhat the visible portion of an eye. However, other non-planar shapes may be utilized such as rectangular or box shapes.

Figure 4A:
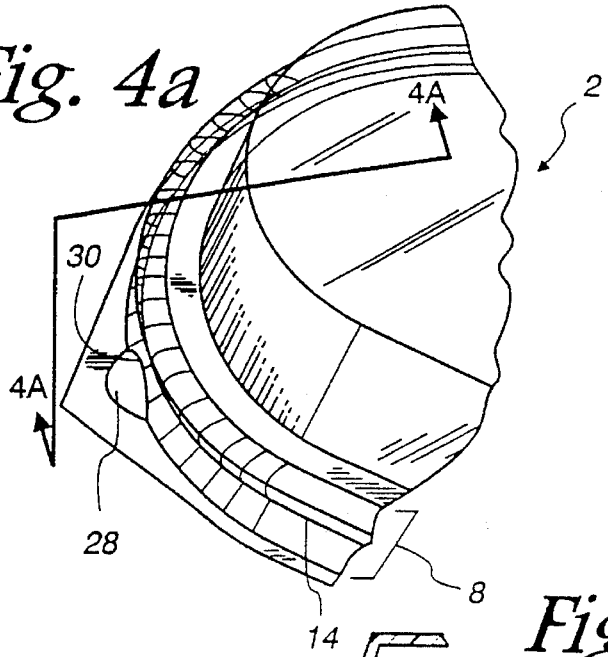
Figure 4B:
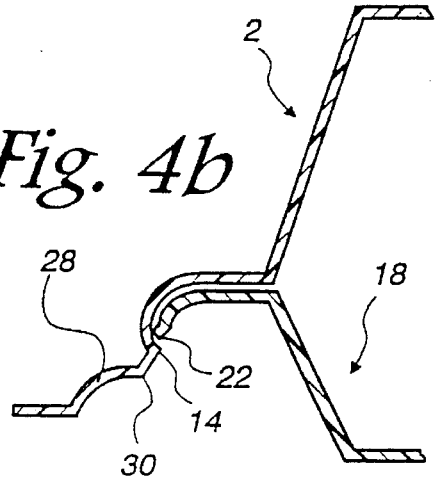

FIG. 4*a* is a perspective view and FIG. 4*b* is a side view of a packaging arrangement having a base 18 and a domed cover 2 incorporating another preferred embodiment of a tab 28. The tab 28 has a top edge 30 engaging the side flange 8 below the undercut 14.

Figure 5A:
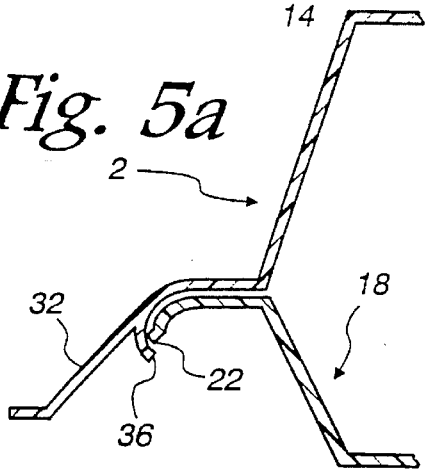
Figure 5B:
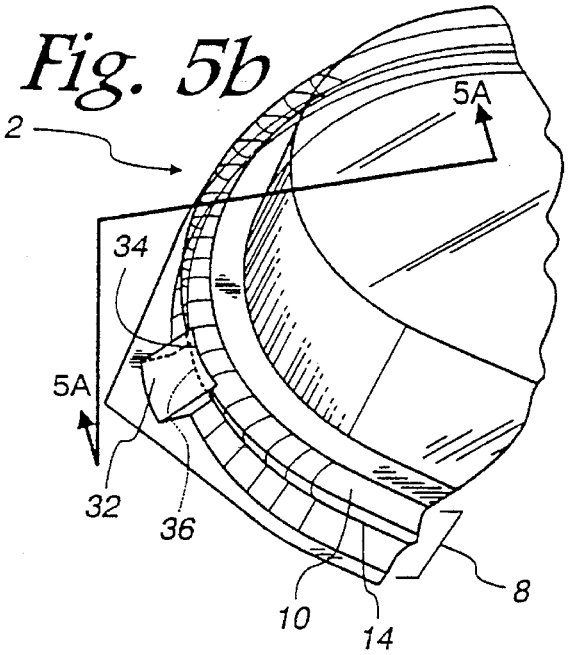

FIG. 5*a* is a perspective view and FIG. 5*b* is a side view of a packaging arrangement having a base 18 and a domed cover 2 incorporating another preferred embodiment of a tab 32. The invented tab 32 has a top edge 34 engaging the side flange 8 above the undercut 14. However, it is important to note that the continuity of the undercut 14 and the upper flange 10 are not interrupted in the vicinity of the tab 32 as indicated by dotted line 36 of FIG. 5*a*. This is in contradistinction to the discontinuity in the undercut 14 of FIG. 2*a* under the indentation tab 6. Accordingly, the tab 32 does not interfere with the continuity of the interface between the base and the cover about the periphery of the packaging arrangement when the undercut 14 releasably engages or snaps over the top-out 22.

Figure 6A:
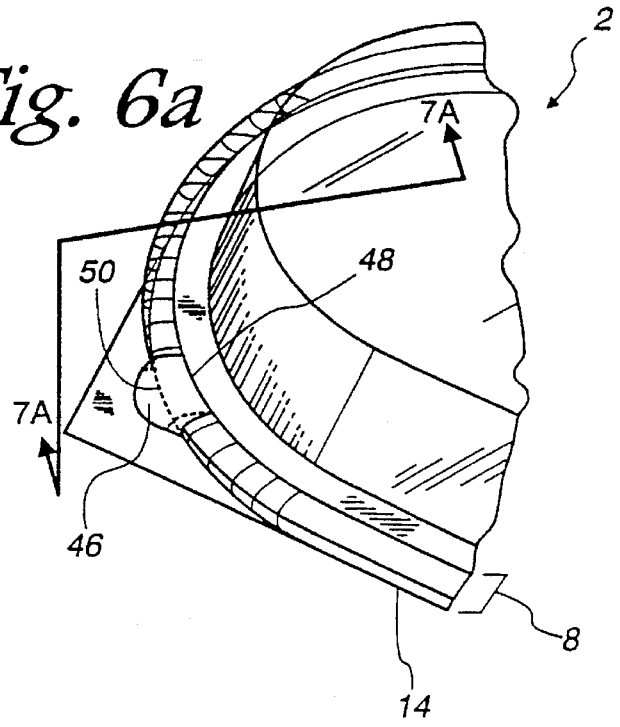
Figure 6B:
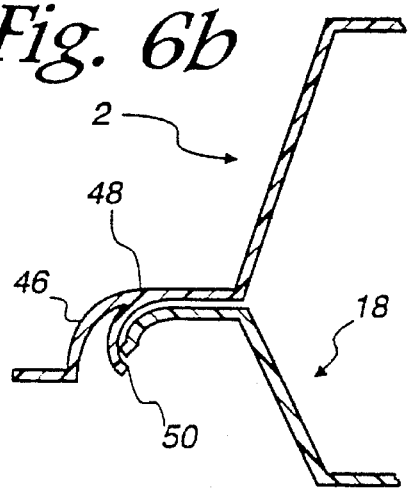

FIG. 6*a* is a perspective view and FIG. 6*b* is a side view of a packaging arrangement having a base 18 and a domed cover 2 incorporating a further preferred embodiment of a tab 46. The tab 46 has a top edge 48 engaging the side flange 8 along the top edge of the side flange 8. As revealed by FIGS. 6*a* and 6*b*, it is not necessary that the side flange 8 comprise both an upper flange and a lower flange with the undercut disposed therebetween. Rather, the undercut 14 may be disposed along the bottom of the side flange 8. However, it is important to note that the continuity of the undercut 14 and the side flange 8 are not interrupted in the vicinity of the tab 46 as indicated by dotted line 50.

Figure 7A:
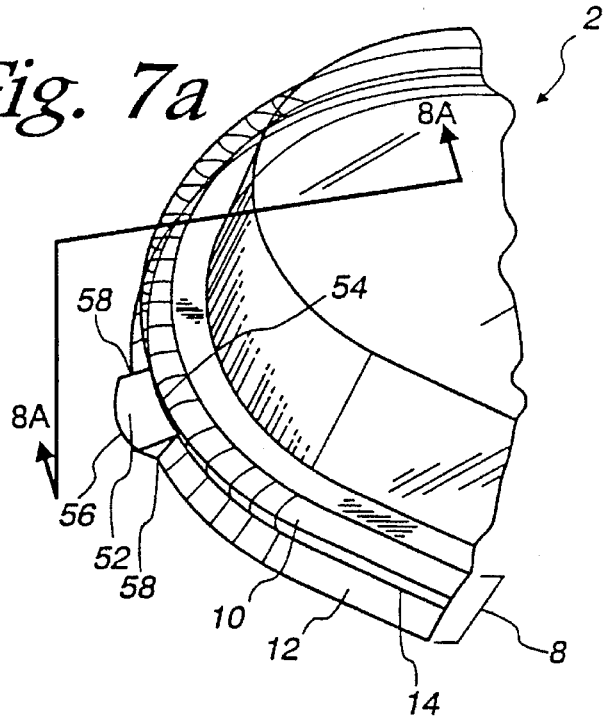
Figure 7B:
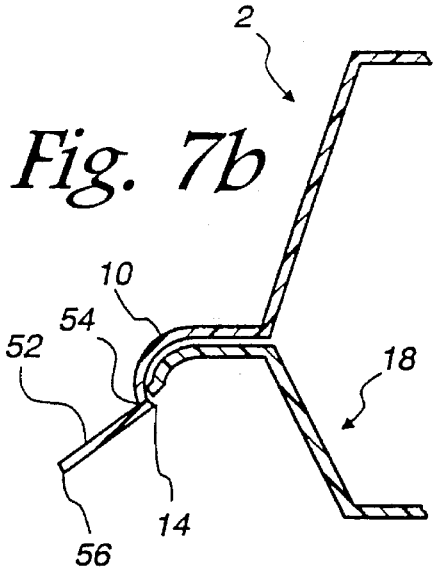

FIG. 7*a* is a perspective view and FIG. 7*b* is a side view of a packaging arrangement having a base 18 and a domed cover 2 incorporating another preferred embodiment of a tab 52. The tab 52 has a top edge 54 engaging the side flange 8 along the undercut 14. The tab 52 has a bottom edge 56 terminating at the side flange 8 at terminating points 58. As revealed by FIG. 7*a*, it is not necessary that cover comprise a bottom flange.

Figure 8:
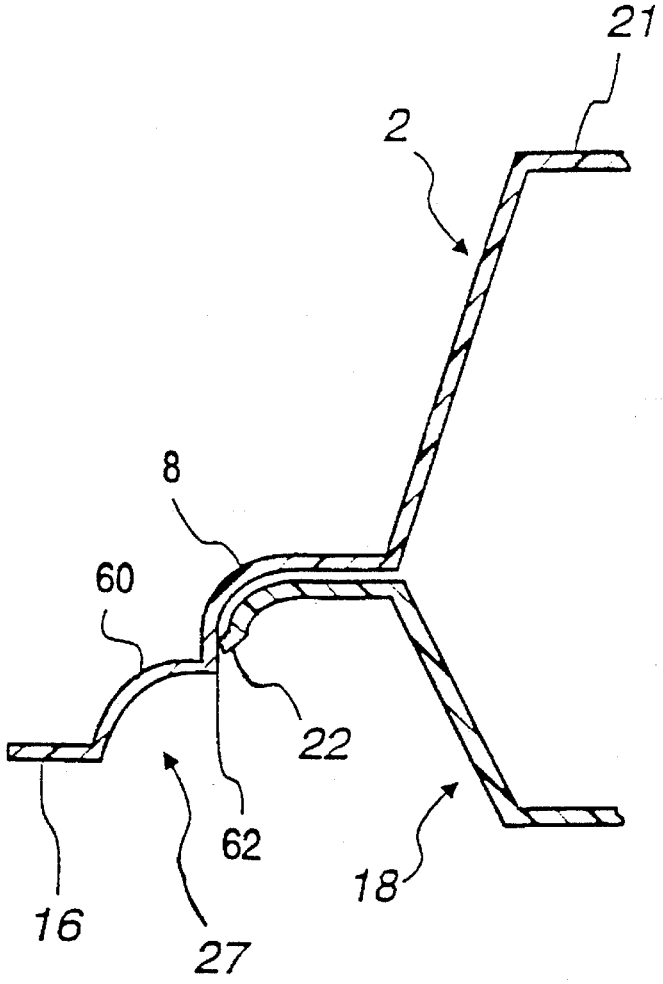
FIG. 8 is a side view of a packaging arrangement having a base and a domed cover incorporating an alternative preferred embodiment of a tab in accordance with the present invention.

The depth of the undercut, that is the horizontal distance between the undercut and the top-out, and the level of the undercut, that is the vertical position of the undercut along the side flange, may be varied from that depicted in FIGS. 3*a* and 3*b* through FIGS. 7*a* and 7*b* without departing from the spirit of the present invention and in fact the depth and/or level of an undercut may be varied about the periphery of a given packaging arrangement. The depth and the level of an undercut may be varied depending on, for example, the size of the packaging arrangement or the thickness of the plastic used. Furthermore, the side flange may be vertical and not possess an undercut. FIG. 8 is a side view of a packaging arrangement having a tab 60 similar to that of tab 20 of FIGS. 3*a* and 3*b* but having a side flange 8 that does not extend inward relative to the top-out 22 of the base 18 so as not to exhibit a distinct undercut. However, the base/cover interface is maintained in the vicinity of the tab 60 by the top-out 22 contacting the side flange 8 at or above the point where the top edge 62 of the tab 60 engages the side flange 8.

Figure 9:
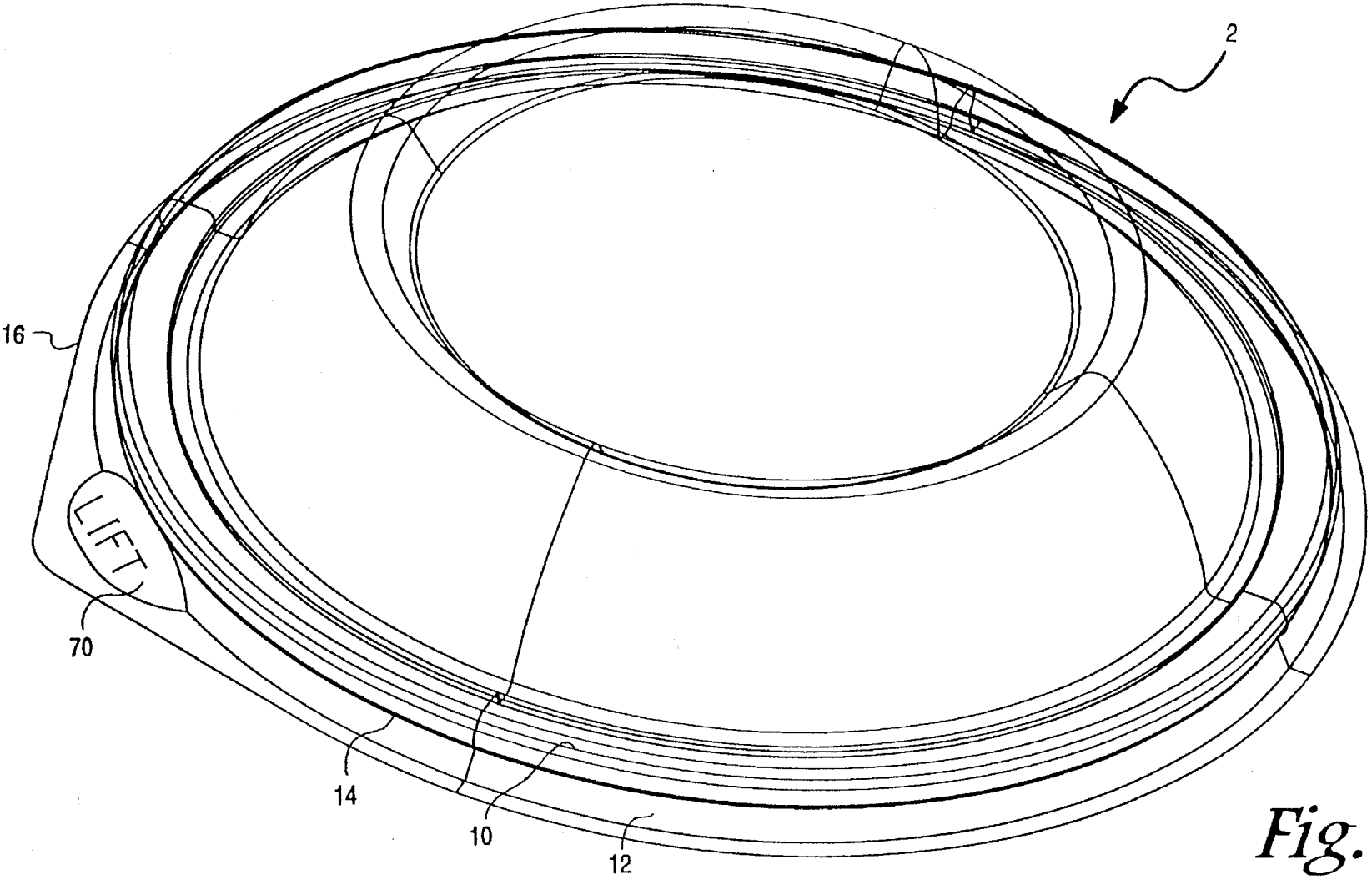
FIG. 9 is a perspective view of a round cover incorporating a preferred embodiment of a tab in accordance with the present invention.

FIG 9 is a perspective view of a cover 2 that is round incorporating a preferred embodiment of a tab 70 in accordance with the present invention. The tab 70 is similar to that of tab 20 of FIGS. 3*a* and 3*b*.

Figure 10:
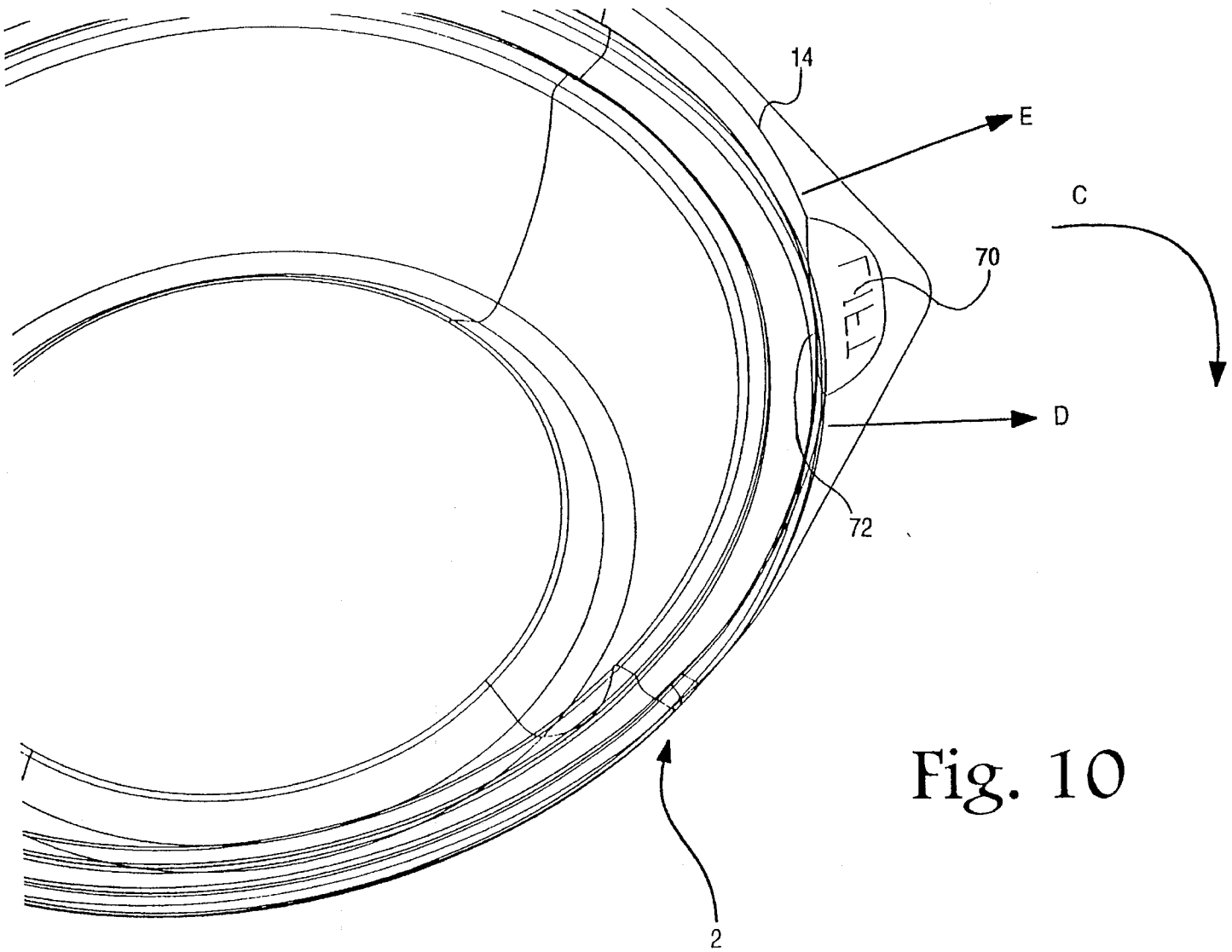
FIG. 10 is a bottom perspective view of the cover of FIG. 9.

FIG. 10 is a bottom perspective view of the cover 2 of FIG. 9. FIG. 10 further illustrates how the design of the tab and its interface with the cover act to draw the undercut away from the top-out of the base. When the tab 70 is bent in the direction C, which in FIG. 10 is a generally downward direction, the tab 70 hinges generally about its top edge 72 which in turn causes the undercut 14 in the vicinity of the tab 70 to move outward and away (directions D and E) from the top-out of a base (not shown). This action of drawing the undercut in the vicinity of the tab away from the undercut contributes to enhanced removeability of the cover from the base.

While the present invention has been described with reference to one or more particular embodiments, those skilled in the art will recognize that many changes may be made thereto without departing from the spirit and scope of the present invention, which is set forth in the following claims.

We claim:

1. A cover for a packaging arrangement, comprising:

a top surface having a periphery;

a side flange extending downwardly from said periphery of said top surface and defining a side periphery, said side flange having an undercut disposed therein for releasably engaging a base of said packaging arrangement, said undercut circumscribing said side periphery in a continuous, unbroken manner;

a bottom flange extending outwardly from said side flange; and a tab having a first edge connected to said side flange and a second edge connected to said bottom flange.

2. The cover of claim 1 wherein said tab is connected to said side flange only below said undercut.

3. The cover of claim 1 wherein said first edge of said tab is connected to said side flange along said undercut.

4. The cover of claim 1 wherein said cover is composed of plastic.

5. The cover of claim 4 wherein said plastic has a thickness ranging from 0.007 to 0.028 of an inch.

6. The cover of claim 4 wherein said plastic has a thickness ranging from 0.010 to 0.016 of an inch.

7. The cover of claim 1 wherein said tab is formed integrally with said side flange.

8. The cover of claim 1 wherein said top surface, said side flange, said bottom flange, and said tab are formed as an integral unit.

9. The cover of claim 1 wherein said side flange comprises an upper flange and a lower flange and wherein said undercut is disposed between said upper flange and said lower flange.

10. The cover of claim 1 wherein said tab has a non-planar shape.

11. The cover of claim 10 wherein said tab has a rounded or spherical shape.

12. The cover of claim 11 wherein said plastic has a thickness ranging from 0.010 to 0.016 of an inch.

13. The cover of claim 10 wherein a cavity is formed adjacent said tab having an opening defined at least in part by the intersection of said tab with said side flange and said bottom flange.

14. A cover for a packaging arrangement, comprising:

a side flange having an undercut disposed therein for releasably engaging a base of said packaging arrangement; and a non-planar shaped tab having a first edge connected to said side flange along the length of said first edge and having a second edge having terminating points, said second edge being connected to said side flange only at the terminating points of said second edge, said undercut extending in a continuous, unbroken manner in the vicinity of said tab.

15. The cover of claim 14 wherein said side flange defines a side periphery, said undercut circumscribing said side periphery in a continuous, unbroken manner.

16. The cover of claim 14 wherein said tab is connected to said side flange only below said undercut.

17. The cover of claim 14 wherein said first edge of said tab is connected to said side flange along said undercut.

18. The cover of claim 14 wherein said cover is composed of plastic.

19. The cover of claim 18 wherein said plastic has a thickness ranging from 0.007 to 0.028 of an inch.

20. The cover of claim 18 wherein said plastic has a thickness ranging from 0.010 to 0.016 of an inch.

21. The cover of claim 14 wherein said tab is formed integrally with said side flange.

22. The cover of claim 14 wherein said top surface, said side flange, said bottom flange, and said tab are formed as an integral unit.

23. The cover of claim 14 further comprising a bottom flange connected to said side flange and said second edge of said tab.

24. The cover of claim 14 wherein said side flange comprises an upper flange and a lower flange and wherein said undercut is disposed between said upper flange and said lower flange.

25. The cover of claim 14 wherein said tab has a non-planar shape.

26. The cover of claim 25 wherein said tab has a rounded or spherical shape.

27. The cover of claim 26 wherein said plastic has a thickness ranging from 0.010 to 0.016 of an inch.

28. A packaging arrangement comprising:

a base; and a cover comprising a top surface having a periphery;

a side flange extending downwardly from said periphery of said top surface and defining a side periphery, said side flange having an undercut disposed therein for releasably engaging said base of the packaging arrangement, said undercut circumscribing said side periphery in a continuous, unbroken manner;

a bottom flange extending outwardly from said side flange; and a tab having a first edge connected to said side flange and a second edge connected to said bottom flange.

29. The packaging arrangement of claim 28 wherein said first edge of said tab is connected to said side flange along or below said undercut.

30. The packaging arrangement of claim 28 wherein said tab is formed integrally with said side flange.

31. The cover of claim 28 wherein said tab has a non-planar shape.

32. The cover of claim 31 wherein said tab has a rounded or spherical shape.

33. A packaging arrangement, comprising:

a base having a top-out; and a cover comprising:

a side flange having an undercut disposed therein for releasably engaging said base of the packaging arrangement; and a non-planar shaped tab having a first edge connected to said side flange along the length of said first edge and having a second edge connected to said side flange only at the terminating points of said second edge, said undercut extending in a continuous, unbroken manner in the vicinity of said tab.

34. The packaging arrangement of claim 33 wherein said first edge of said tab is connected to said side flange along or below said undercut.

35. The packaging arrangement of claim 34 wherein said tab is formed integrally with said side flange.

36. The cover of claim 33 wherein said tab has a rounded or spherical shape.

37. A cover for a packaging arrangement, comprising:

a side flange having a vertical portion for releasably engaging a base of said packaging arrangement, the base engaging said side flange along a base/side flange interface; and a non-planar shaped tab having a top edge connected to said side flange along the length of said top edge and having a second edge having terminating points, said second edge being connected to said side flange only at the terminating points of said second edge, said top edge being connected to said side flange at or below said base/side flange; said base/side flange interface being continuous and unbroken manner in the vicinity of said tab.

* * * * *